US009755364B2

(12) United States Patent
Barak et al.

(10) Patent No.: US 9,755,364 B2
(45) Date of Patent: Sep. 5, 2017

(54) ELECTRICAL PLUG WITH DISENGAGEMENT MEMBER

(71) Applicant: Medical Compression Systems (DBN) Ltd., Or Akiva (IL)

(72) Inventors: Jacob Barak, Oranit (IL); Vitaly Rondel, Hadera (IL)

(73) Assignee: MEDICAL COMPRESSION SYSTEMS (IL)

( * ) Notice: Subject to any disclaimer, the term of this patent is extended or adjusted under 35 U.S.C. 154(b) by 0 days.

(21) Appl. No.: 14/812,136

(22) Filed: Jul. 29, 2015

(65) Prior Publication Data

US 2016/0064859 A1 Mar. 3, 2016

Related U.S. Application Data

(60) Provisional application No. 62/043,474, filed on Aug. 29, 2014.

(51) Int. Cl.

| | |
|---|---|
| ***H01R 13/633*** | (2006.01) |
| ***H01R 24/28*** | (2011.01) |
| *H01R 13/46* | (2006.01) |
| *H01R 101/00* | (2006.01) |

(52) U.S. Cl.

CPC ..... *H01R 13/633* (2013.01); *H01R 24/28* (2013.01); *H01R 13/465* (2013.01); *H01R 2101/00* (2013.01); *H01R 2201/20* (2013.01)

(58) Field of Classification Search

CPC ..... H01R 13/633; H01R 13/6335; H01R 13/465; H01R 24/28

USPC ..... 439/483, 694, 484, 669

See application file for complete search history.

(56) References Cited

U.S. PATENT DOCUMENTS

| | | | | |
|---|---|---|---|---|
| 1,699,722 | A | 1/1929 | Stott | |
| 2,507,092 | A | 5/1950 | Cline | |
| 5,057,036 | A | 10/1991 | Dickie | |
| 5,454,731 | A | 10/1995 | Dickie | |
| 5,567,181 | A * | 10/1996 | Lentz | H01R 13/6335 439/484 |
| 5,915,997 | A * | 6/1999 | Lan-Jen | H01R 13/6335 439/694 |
| 5,971,733 | A * | 10/1999 | Huang | B29C 45/14639 264/272.15 |
| 6,736,666 | B2 | 5/2004 | Yu | |
| 7,025,623 | B2 * | 4/2006 | Katsumata | G06K 19/077 361/737 |
| 7,052,309 | B1 | 5/2006 | Chen | |
| 7,556,524 | B2 | 7/2009 | Kuo et al. | |
| 7,625,230 | B2 | 12/2009 | Boerner | |
| D661,651 | S | 6/2012 | Smith et al. | |
| 8,512,069 | B2 | 8/2013 | Kao et al. | |
| 8,641,443 | B1 | 2/2014 | Moussa et al. | |
| 8,647,133 | B2 | 2/2014 | Saur | |
| D701,835 | S | 4/2014 | Byrne et al. | |

(Continued)

*Primary Examiner* — Ross Gushi

(74) *Attorney, Agent, or Firm* — Gesmer Updegrove LLP

(57) ABSTRACT

An electrical connector for facilitating disconnection from an electrical device by an operator includes an electrical cord and an electrical plug device attached to an end of the electrical cord and having a planar surface. The electrical plug device includes an electrical connector perpendicular to the planar surface of the electrical plug device and a disengagement member. The electrical cord is electrically connected to the electrical connector through the electrical plug device.

15 Claims, 7 Drawing Sheets

(56) References Cited

U.S. PATENT DOCUMENTS

| | | | | |
|---|---|---|---|---|
| D705,738 | S | 5/2014 | Schmidt et al. | |
| 8,727,812 | B2 | 5/2014 | Villarreal et al. | |
| D706,720 | S | 6/2014 | Gette | |
| D707,181 | S | 6/2014 | Schmidt et al. | |
| 8,764,485 | B2 | 7/2014 | Hohner et al. | |
| 8,851,935 | B2 * | 10/2014 | Yoshioka | H01R 4/023 439/604 |

* cited by examiner

ELECTRICAL PLUG WITH DISENGAGEMENT MEMBER

PRIORITY INFORMATION

This application claims priority under 35 U.S.C. §119 to U.S. Provisional Patent Application Ser. No. 62/043,474, which was filed on Aug. 29, 2014. The entire content of U.S. Provisional Patent Application Ser. No. 62/043,474, which was filed on Aug. 29, 2014, is hereby incorporated by reference.

BACKGROUND

Since the inception of the power plug and socket, disconnecting a plug from a socket has evolved as a basic problem. Too often the disconnection of the plug from the socket is accomplished by pulling on the power cord. Grasping the plug and pulling to remove from the socket proves to be particularly detrimental to the structure of the plug.

FIG. 1 illustrates a conventional low profile electrical plug with associated electrical cord 30. The low profile electrical plug includes a housing 20, usually made of electrically insulating material, and an electrical plug 10.

One characteristic of a conventional low profile electrical plug, as illustrated in FIG. 2, is that the plug or electrical connector 10 is perpendicular or normal to the associated electrical cord 30. This enables the electrical plug to be used in places of low clearance without putting undue strain on the electrical cord 30, due to the bending of the electrical cord 30 caused by the low clearance situation.

On the other hand, a conventional non-low profile electrical plug, as illustrated in FIG. 3, has the electrical connector 10 and housing 20 in a parallel or planar relationship to the associated electrical cord 30. Thus, in a situation of low clearance, the electrical cord 30 must bend (as shown by the dotted lines), putting an undesired strain on the electrical cord and causing premature fatigue in the cord.

As noted above, a conventional low profile electrical plug has the electrical connectors 10 in a perpendicular or normal relationship to the associated electrical cord 30, wherein the bend is in the housing 20, thereby minimizing any undesired strain on the electrical cord 30 and preventing premature fatigue in the cord 30.

The following U.S. patents are examples of conventional solution for disconnecting a plug from a socket without relying upon the pulling of the cord.

U.S. Pat. No. 1,699,722 discloses an attachment for use in removing an electric plug from its socket. This involves the provision of a handle or bail securely attached to the plug and projecting outwardly at the center where it will naturally be in position to grasp. The entire content of U.S. Pat. No. 1,699,722 is hereby incorporated by reference.

U.S. Pat. No. 2,507,092 discloses plug caps for electrical outlets. The entire content of U.S. Pat. No. 2,507,092 is hereby incorporated by reference.

U.S. Pat. No. 5,057,036 discloses a pivotable pull ring permanently attached to a low profile electrical plug by fashioning a locking stub at the attaching ends of the pull ring. The entire content of U.S. Pat. No. 5,057,036 is hereby incorporated by reference.

U.S. Pat. No. 5,454,731 discloses a molded plastic low profile electrical plug comprising a thin molded plastic main body member, two electrically conductive blade members adapted for insertion into an electrical outlet, and two wire members forming an electrical cord. The entire content of U.S. Pat. No. 5,454,731 is hereby incorporated by reference.

U.S. Pat. No. 6,736,666 discloses electrical plugs capable of being easily removed from their associated receptacles with the aid of a pull ring. The entire content of U.S. Pat. No. 6,736,666 is hereby incorporated by reference.

U.S. Pat. No. 7,052,309 discloses an electric plug including two locating blocks aligned at two sides of the housing thereof to pivotally hold a substantially C-shaped pull ring. The entire content of U.S. Pat. No. 7,052,309 is hereby incorporated by reference.

Although above example provide a mechanism to remove an electrical plug from a socket, example requires a clearance to grasp and pull the plug away from the socket. However, in certain situations, there is not enough clearance to pull the plug away from the socket, it must be pushed.

Therefore, it is desirable to provide an electrical plug which allows a user to disengage the electrical plug from the socket using a pushing action.

Moreover, it is desirable to provide an electrical plug which allows a user to disengage the electrical plug from the socket that lacks sufficient clearance without requiring the user to utilize the cord.

In addition, it is desirable to provide an electrical plug which allows a user to disengage the electrical plug from the socket that lacks sufficient clearance by using a pushing action while not requiring the user to utilize the cord.

BRIEF DESCRIPTION OF THE DRAWINGS

The drawings are only for purposes of illustrating various embodiments and are not to be construed as limiting, wherein.

DETAILED DESCRIPTION

Figure 1:
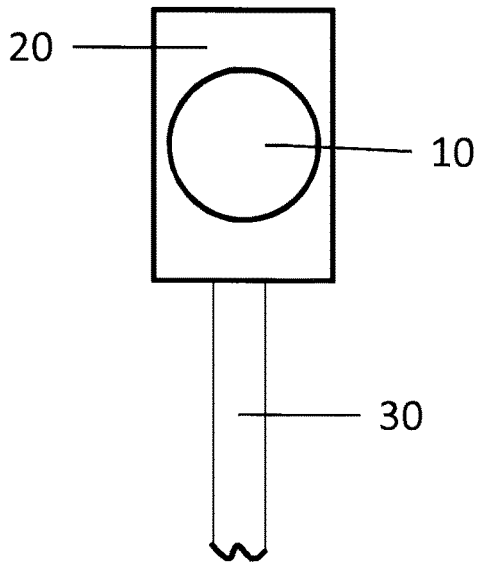
FIG. 1 illustrates a conventional low profile electrical connector.
Figure 2:
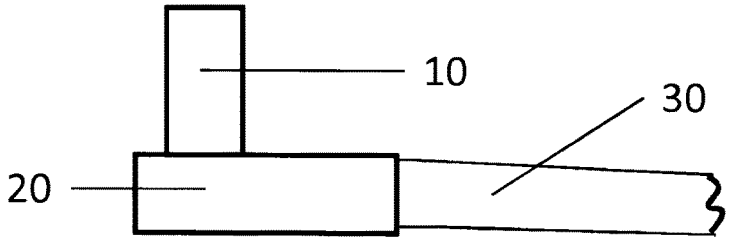
FIG. 2 illustrates a side view of the conventional low profile electrical connector of FIG. 1.
Figure 3:
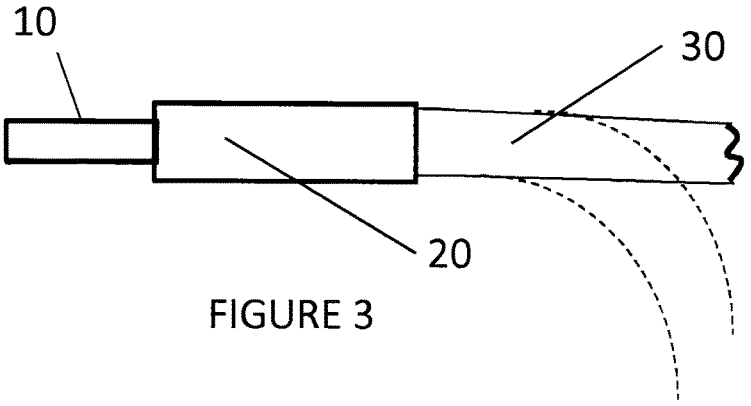
FIG. 3 illustrates a conventional non-low profile electrical connector.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 4:
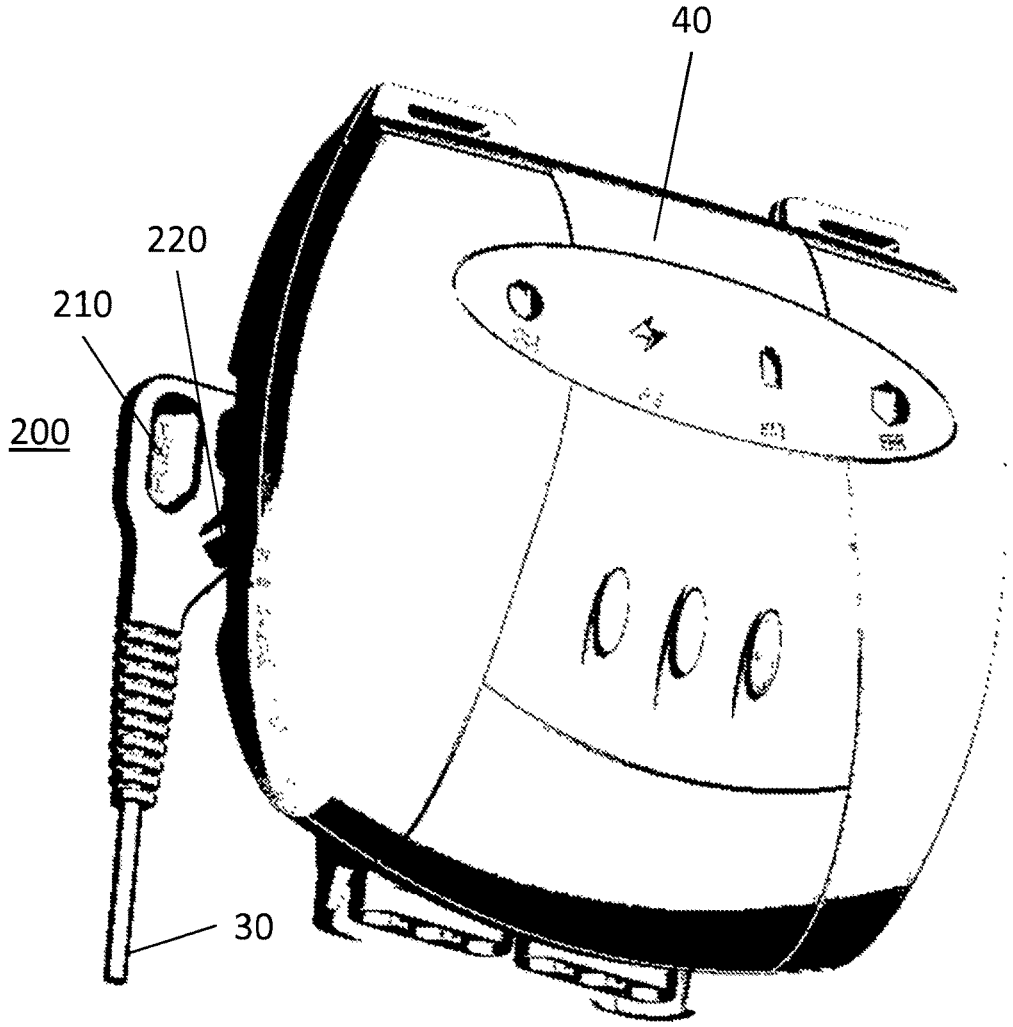
FIG. 4 is an illustration showing an electrical device with a low profile electrical connector having a push action disengagement mechanism.

As illustrated in FIG. 4, an electrical device 40 receives electrical power via and electrical cord 30 having an electrical plug device 200 at one end of the electrical cord 30.

The electrical plug device 200 includes a disengagement member 210 and an optional plug reinforcement member 220. The electrical plug device 200 is a low profile electrical connector, wherein the electrical plug, not shown, is perpendicular or normal to the associated electrical cord 30. More specifically, the electrical plug, not shown, plugs into the backside of the electrical device 40.

The actual structure of the electrical plug device 200 will be discussed in more detail below, with respect to FIGS. 5-9.

Figure 5:
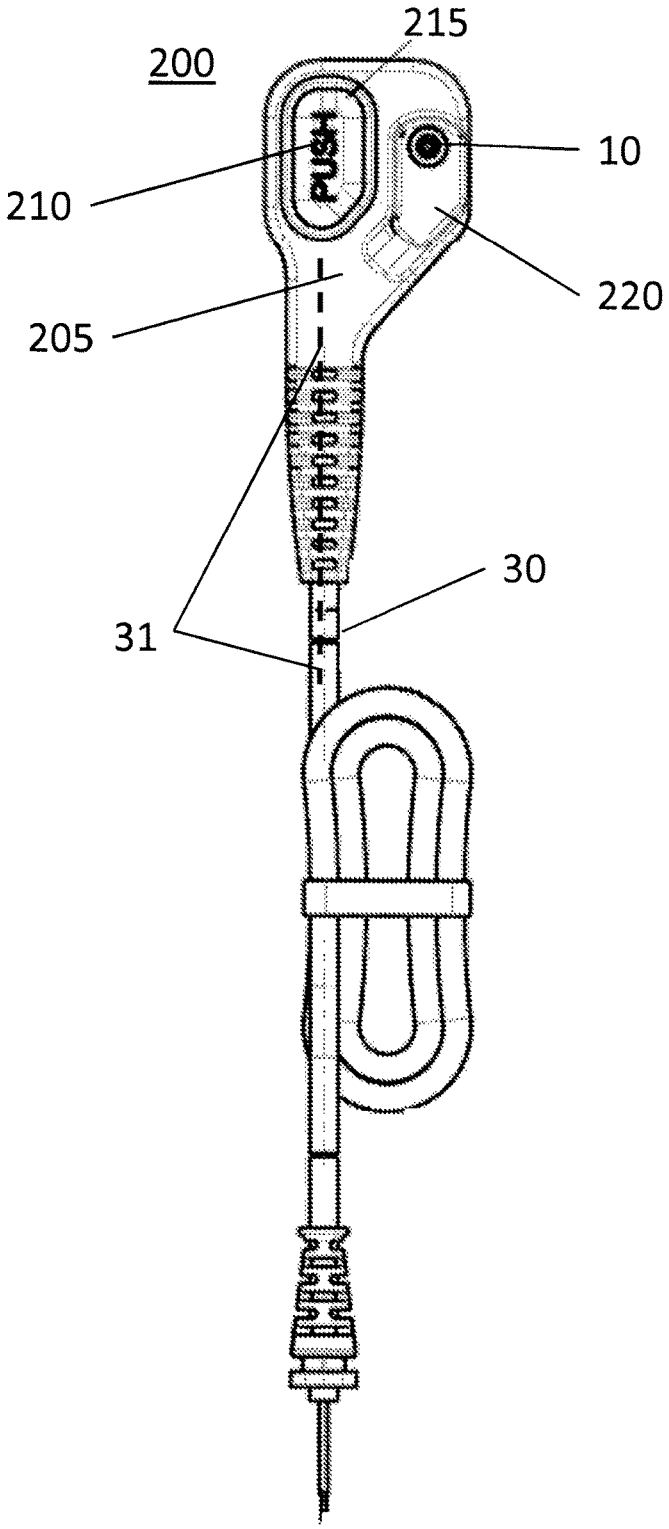
FIG. 5 is an illustration showing an electrical cord with a low profile electrical connector having a push action disengagement mechanism.

As illustrated in FIG. 5, electrical cord 30 terminates with an electrical plug device 200. The electrical plug device 200 includes a disengagement member 210, an electrical plug 10, and an optional plug reinforcement member 220.

The electrical cord 30 has a centerline 31, which runs along a center axis of the electrical cord 30 if the electrical cord 30 is substantially cylindrical. In other words, the centerline 31 represents a center-based line of the electrical cord 30.

As illustrated in FIG. 5, the electrical plug 10 is offset from the centerline 31 such that the overall shape of the electrical plug device 200 has a P-shape or D-Shape. The offsetting of the electrical plug 10 from the centerline 31 allows the electrical plug 10 to be plugged into the electrical device with the associated electrical cord 30 being offset from the electrical device.

Moreover, the offsetting of the electrical plug 10 from the centerline 31 allows the disengagement member 210 to be physically cleared from the electrical device, thereby enabling a user to easily engage the disengagement member 210 to disengage the electrical plug 10 from the electrical device.

As noted above, the electrical plug device 200 includes an optional plug reinforcement member 220, which provides mechanical strength to the electrical plug 10.

It is noted that the plug reinforcement member 220 may have a unique shape which is associated with a corresponding shape (not shown) on the electrical device to prevent an incorrect electrical cord 30 and electrical plug device 200 assembly from being used with the electrical device. For example, the plug reinforcement member 220 may have a rectangular shape and the corresponding shape on the electrical device would be an indentation for receiving the rectangular shape of the plug reinforcement member 220.

As illustrated in FIG. 5, a center point of the disengagement member 210 is located along the centerline 31 of the associated electrical cord 30. The locating of the center point of the disengagement member 210 along the centerline 31 of the associated electrical cord 30 enables the user to easily engage the disengagement member 210 to disengage the electrical plug 10 from the electrical device.

It is noted that the disengagement member 210 disengages the electrical plug 10 from the electrical device when the users pushes the disengagement member 210 in a direction away from the electrical device. The pushing action prevents a strain from being placed upon the associated electrical cord 30.

Figure 6:
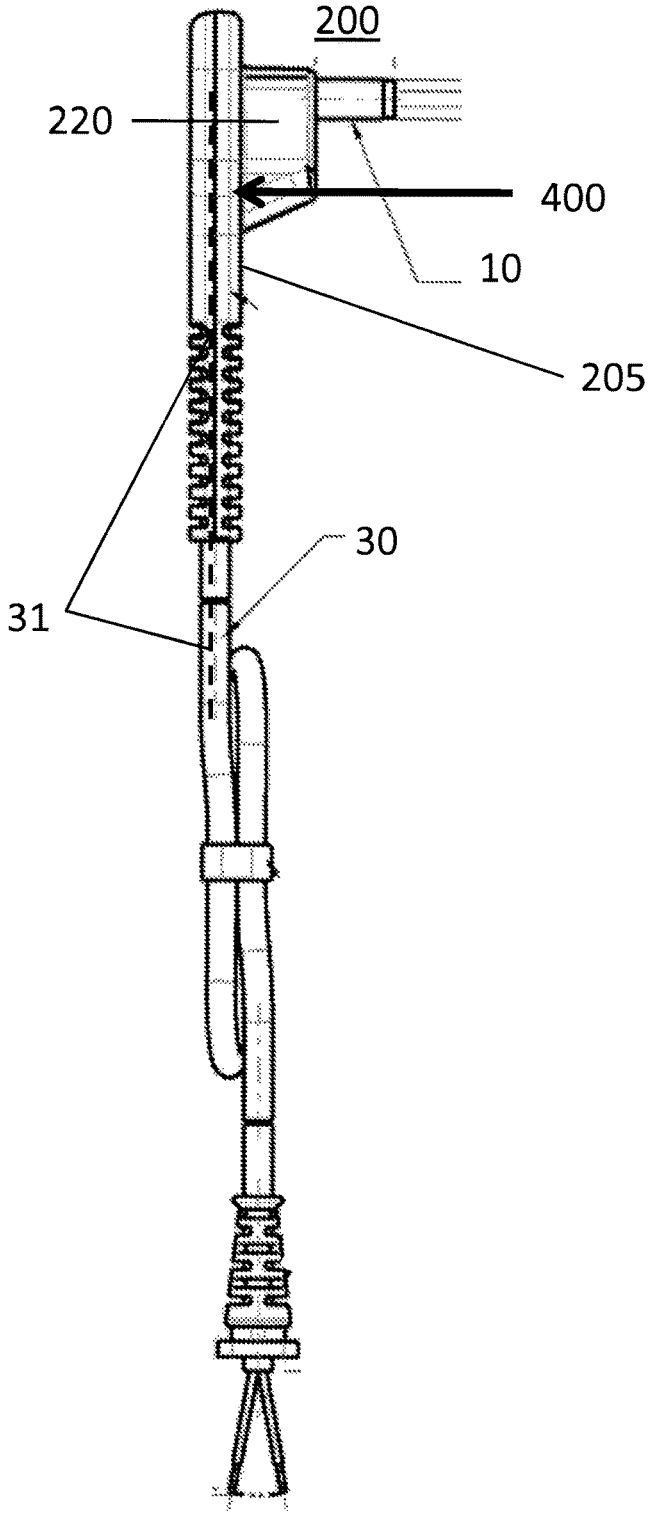
FIG. 6 is an illustration showing a side view of the electrical device with the low profile electrical connector of FIG. 5.

In other words, as illustrated in FIG. 6, the electrical plug 10 is perpendicular or normal to the centerline 31 of the associated electrical cord 30 in a direction towards engagement with an electrical device. It is also noted that the electrical plug 10 is also perpendicular or normal to a planar surface 205 of the electrical plug device 200.

The disengagement member 210 disengages the electrical plug 10 from the electrical device when the users pushes the disengagement member 210 in a direction (400) perpendicular or normal to the centerline 31 of the associated electrical cord 30, but opposite of the direction of electrical plug 10.

Figure 9:
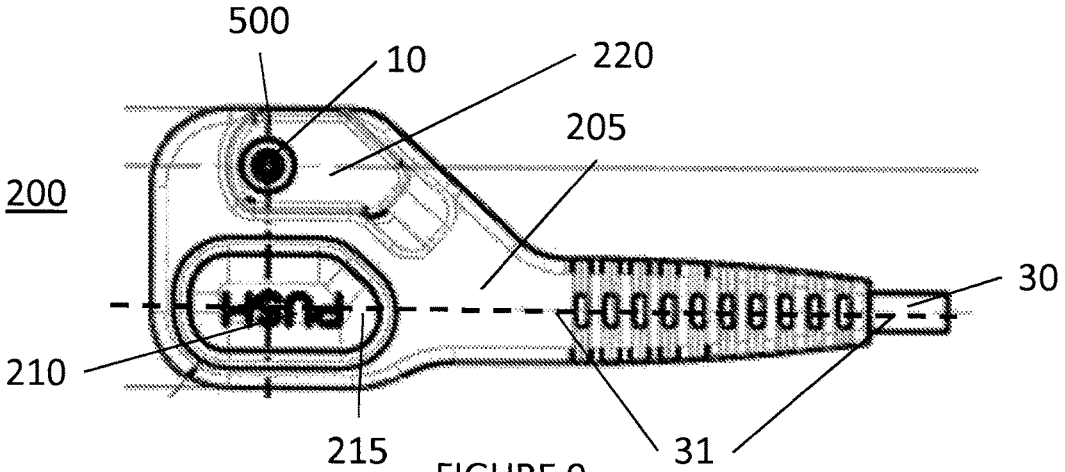
FIG. 9 is an illustration showing a top view of the low profile electrical connector of FIG. 7.

As illustrated in FIGS. 4, 5, and 9, the disengagement member 210 may include a physical demarcation 215 (tactilely discernible indentation), on a top side, to inform the user where to apply pushing action so as to disengage the electrical plug 10 from the electrical device.

Figure 7:
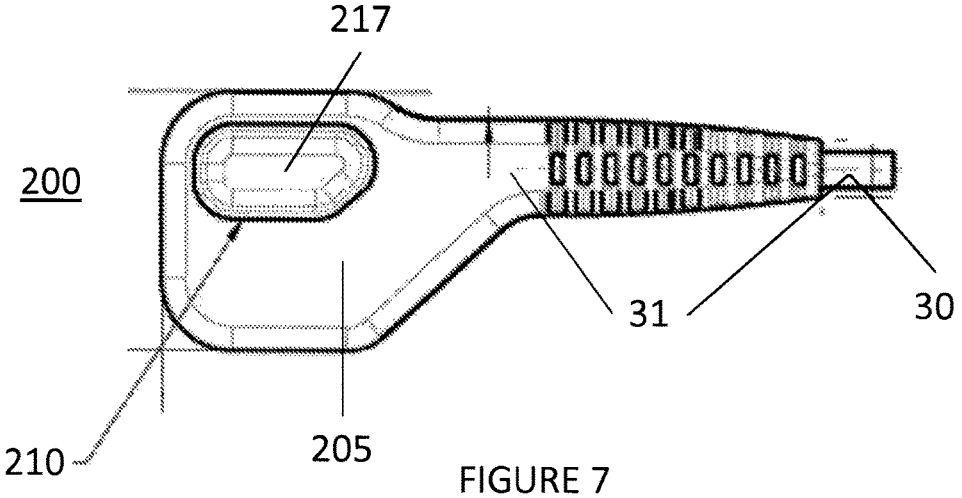
FIG. 7 is an illustration showing a bottom view of a low profile electrical connector having a push action disengagement mechanism.

As illustrated in FIG. 7, the disengagement member 210 may include a physical demarcation 217 (tactilely discernible protrusion), on a bottom side, to inform the user that pushing action is to be applied to an opposite side so as to disengage the electrical plug 10 from the electrical device.

Moreover, as illustrated in FIGS. 4, 5, and 9, the disengagement member 210 may include a visible (human readable) demarcation, on a top side, to inform the user where to apply pushing action so as to disengage the electrical plug 10 from the electrical device.

FIG. 7 illustrates a bottom view of the electrical cord 30 and electrical plug device 200 assembly, wherein the center point of the disengagement member 210 is located along the centerline 31 of the associated electrical cord 30. The user would apply a pushing action to an opposite side of the shown electrical cord 30 and electrical plug device 200 assembly to disengage the electrical plug 10 from the electrical device.

Figure 8:
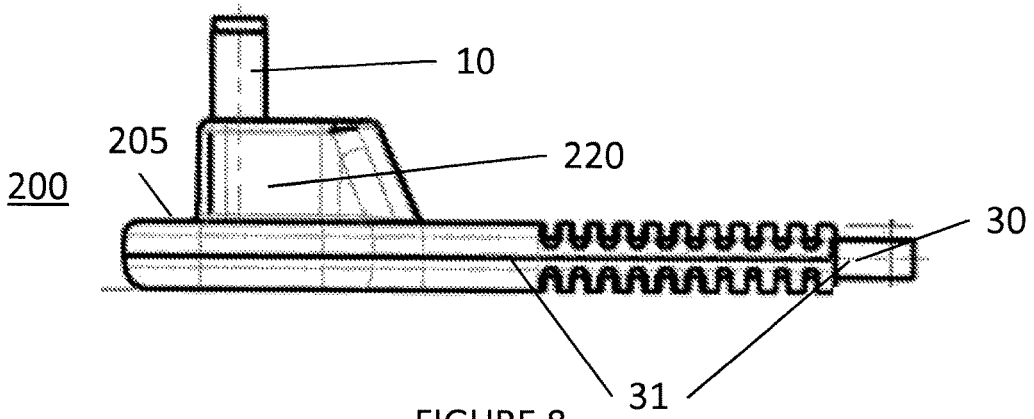
FIG. 8 is an illustration showing a side view of the low profile electrical connector of FIG. 7.

FIG. 8 illustrates a side view of the electrical cord 30 and electrical plug device 200 assembly, wherein the electrical plug 10 is perpendicular or normal to a planar surface 205 of the electrical plug device 200 and perpendicular or normal to the centerline 31 of the associated electrical cord 30 in a direction towards engagement with an electrical device.

As illustrated in FIG. 8, the optional plug reinforcement member 220, which provides mechanical strength to the electrical plug 10, may also be perpendicular or normal to a planar surface 205 of the electrical plug device 200 and perpendicular or normal to the centerline 31 of the associated electrical cord 30 in a direction towards engagement with an electrical device.

FIG. 9 illustrates a top view of the electrical cord 30 and electrical plug device 200 assembly, wherein the electrical plug 10 is perpendicular or normal to a planar surface 205 of the electrical plug device 200 and perpendicular or normal to the centerline 31 of the associated electrical cord 30 in a direction towards engagement with an electrical device.

As illustrated in FIG. 9, the optional plug reinforcement member 220, which provides mechanical strength to the electrical plug 10, may also be perpendicular or normal to a planar surface 205 of the electrical plug device 200 and perpendicular or normal to the centerline 31 of the associated electrical cord 30 in a direction towards engagement with an electrical device.

Furthermore, as illustrated in FIG. 9, the electrical plug 10 is offset from the centerline 31 such that the overall shape of the electrical plug device 200 has a P-shape or D-Shape, and the disengagement member 210 is located along the centerline 31 of the associated electrical cord 30.

The locating of the center point of the disengagement member 210 along the centerline 31 of the associated electrical cord 30 and the offsetting of the electrical plug 10 from the centerline 31 enables the user to easily engage the disengagement member 210 to disengage the electrical plug 10 from the electrical device and allows the electrical plug 10 to be plugged into the electrical device with the associated electrical cord 30 being offset from the electrical device.

As shown in FIG. 9, a line 500, passing through the center point of the disengagement member 210 and a center point of the electrical plug 10 intersects the centerline 31 of the electrical cord 30 to form a substantially orthogonal angle.

The alignment of the center point of the disengagement member 210 and the center point of the electrical plug 10, as illustrated in FIG. 9, allows the disengagement of the electrical plug 10 from an electrical device with ease and minimal stress upon the electrical cord 30 and/or the electrical plug device 200.

It is noted that although the electrical plug 10 has been illustrated as a male connector, the electrical plug device 200 could be modified to replace the male connector with a female connector to receive a male connector located on the electrical device.

It is also noted that although the electrical plug 10 has been illustrated as a male connector, the electrical plug device 200 could be modified to utilize other types of removal electrical connectors.

It is noted that the disengagement member 210 and the optional plug reinforcement member 220 may be integrally formed or separate components fused together in forming the electrical plug device 200.

It is further noted that the disengagement member 210 and the optional plug reinforcement member 220 may be formed of rigid electrically insulating material.

Figure 10:
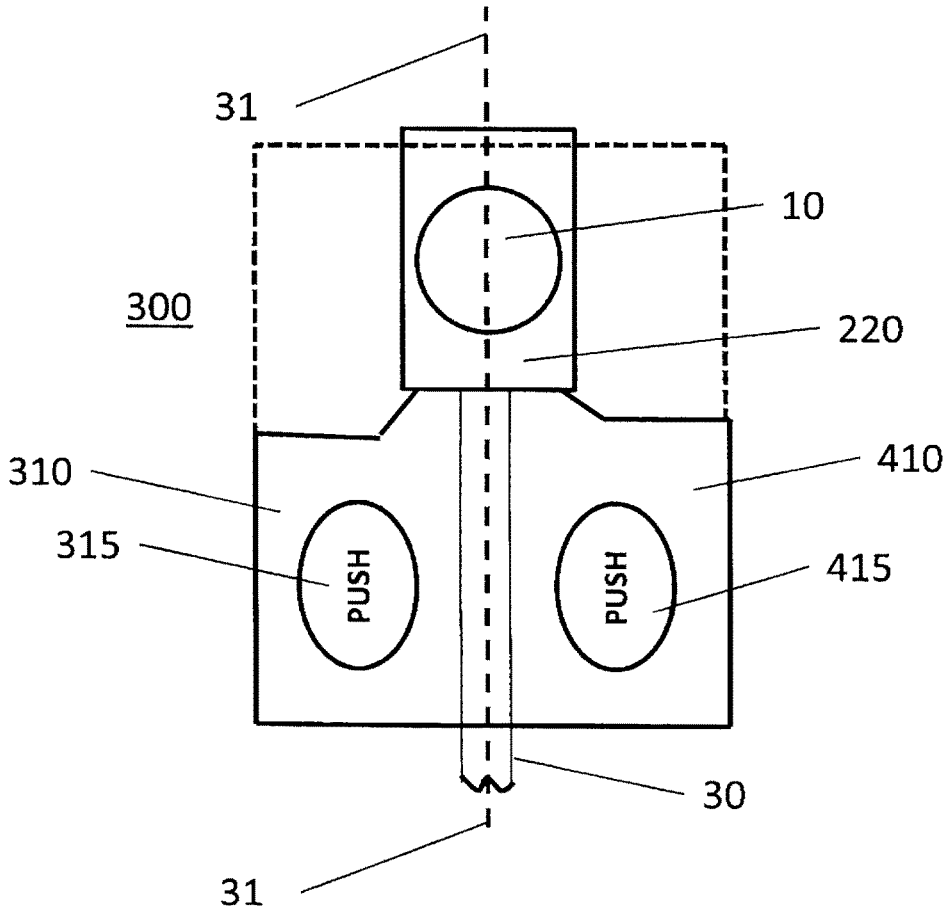
FIG. 10 is an illustration showing a top view of another low profile electrical connector.

With respect to FIG. 10, electrical cord 30 terminates with an electrical plug device 300. The electrical plug device 300 includes first disengagement member 310, second disengagement member 410, an electrical plug 10, and an optional plug reinforcement member 220.

The electrical cord 30 has a centerline 31, which runs along a center axis of the electrical cord 30 if the electrical cord 30 is substantially cylindrical. In other words, the centerline 31 represents a center-based line of the electrical cord 30.

As illustrated in FIG. 10, the electrical plug 10 is located along or on the centerline 31 and the first disengagement members 310 and the second disengagement member 410 are offset from the centerline 31 such that the overall shape of the electrical plug device 300 has an upside down T-shape. As illustrated in FIG. 10, the first disengagement member 310 may include a physical demarcation 315 (tactilely discernible indentation), on a top side, to inform the user where to apply pushing action so as to disengage the electrical plug 10 from the electrical device and the second disengagement member 410 may include a physical demarcation 415 (tactilely discernible indentation), on a top side, to inform the user where to apply pushing action so as to disengage the electrical plug 10 from the electrical device. Moreover, as illustrated in FIG. 10, the first disengagement member 310 may include a visible (human readable) demarcation, on a top side, to inform the user where to apply pushing action so as to disengage the electrical plug 10 from the electrical device and the second disengagement member 410 may include a visible (human readable) demarcation, on a top side, to inform the user where to apply pushing action so as to disengage the electrical plug 10 from the electrical device.

It is noted that the first disengagement members 310 and the second disengagement member 410 may be expanded (as shown by the dotted line) so that the overall shape of the electrical plug device 300 is basically square or rectangular.

The offsetting of the first disengagement members 310 and the second disengagement member 410 from the centerline 31 allows the electrical plug 10 to be plugged into the electrical device with the associated electrical cord 30 being orthogonal to the electrical device.

It is noted that the first disengagement member 310 and the second disengagement member 410 may be integrally formed. It is further noted that the associated electrical cord 30 may be formed in the integrally formed first disengagement members 310 and second disengagement member 410 or the associated electrical cord 30 may not be physically connected to the first disengagement members 310 and the second disengagement member 410.

Figure 11:
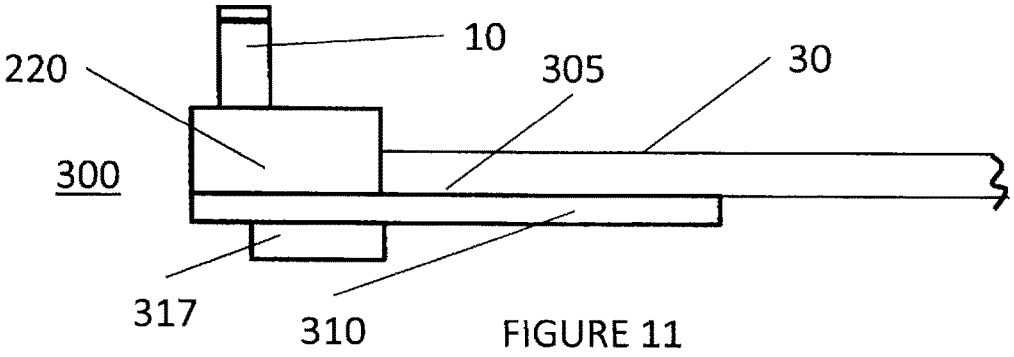
FIG. 11 is an illustration showing a side view of the low profile electrical connector of FIG. 10.

FIG. 11 illustrates a side view of the electrical cord 30 and electrical plug device 300 assembly, wherein the electrical plug 10 is perpendicular or normal to a planar surface 305 of the electrical plug device 300 and perpendicular or normal to the centerline 31 of the associated electrical cord 30 in a direction towards engagement with an electrical device.

As illustrated in FIG. 11, the optional plug reinforcement member 220, which provides mechanical strength to the electrical plug 10, may also be perpendicular or normal to a planar surface 305 of the electrical plug device 300 and perpendicular or normal to the centerline 31 of the associated electrical cord 30 in a direction towards engagement with an electrical device. As illustrated in FIG. 11, the first disengagement member 310 may include a physical demarcation 317 (tactilely discernible protrusion), on a bottom side, to inform the user that pushing action is to be applied to an opposite side so as to disengage the electrical plug 10 from the electrical device.

Figure 12:
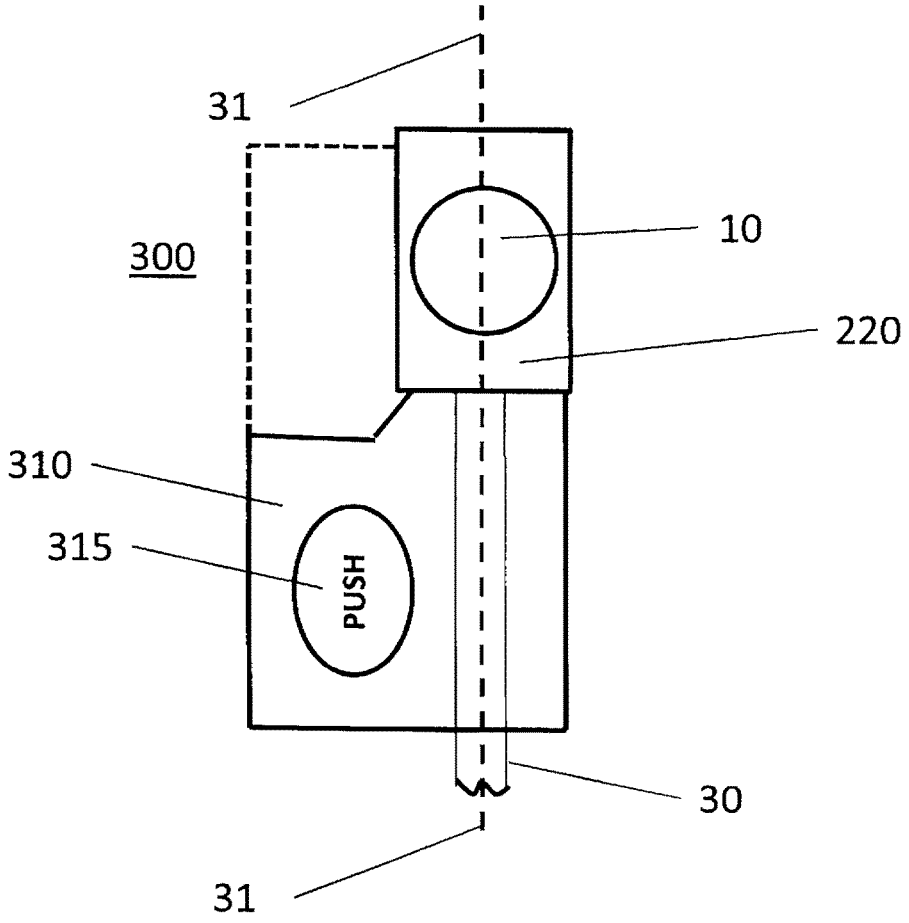
FIG. 12 is an illustration showing a top view of another low profile electrical connector.

As illustrated in FIG. 12, the electrical plug 10 is located along or on the centerline 31 and the disengagement member 310 is offset from the centerline 31 such that the overall shape of the electrical plug device 300 has an upside down P-shape or a d-shape. As illustrated in FIG. 12, the disengagement member 310 may include a physical demarcation 315 (tactilely discernible indentation), on a top side, to inform the user where to apply pushing action so as to disengage the electrical plug 10 from the electrical device. Moreover, as illustrated in FIG. 12, the disengagement member 310 may include a visible (human readable) demarcation, on a top side, to inform the user where to apply pushing action so as to disengage the electrical plug 10 from the electrical device.

It is noted that the disengagement member 310 may be expanded (as shown by the dotted line) so that the overall shape of the electrical plug device 300 is basically rectangular.

The offsetting of the disengagement member 310 from the centerline 31 allows the electrical plug 10 to be plugged into the electrical device with the associated electrical cord 30 being orthogonal to the electrical device.

It is noted that the disengagement member 310 may be integrally formed with the associated electrical cord 30 or the associated electrical cord 30 may not be physically connected to the disengagement member 310.

It is noted that although FIG. 12 illustrates the disengagement member 310 offset to the left of the centerline 31 of the associated electrical cord 30, the disengagement member 310 may also be offset to the right of the centerline 31 of the associated electrical cord 30.

In summary, an electrical connector for facilitating disconnection from an electrical device by an operator includes an electrical cord having a centerline and an electrical plug device attached to an end of the electrical cord and having a planar surface. The electrical plug device includes an electrical connector perpendicular to the planar surface of the electrical plug device, and a disengagement member located along the centerline of the electrical cord. The electrical connector is offset from the centerline of the electrical cord. The electrical cord is electrically connected to the electrical connector through the electrical plug device.

The electrical plug device may include plug reinforcement member for the electrical connector, the plug reinforcement member being offset from the centerline of the electrical cord.

The disengagement member may include a tactilely discernible indentation to inform a user where to apply a pushing action so as to disengage the electrical connector from the electrical device.

The disengagement member may include a tactilely discernible protrusion to inform a user that a pushing action is to be applied to an opposite side so as to disengage the electrical connector from the electrical device.

The disengagement member may include a visible human readable demarcation to inform a user where to apply a pushing action so as to disengage the electrical connector from the electrical device.

A line, passing through a center point of the disengagement member and a center point of the electrical connector may intersect the centerline of the electrical cord to form a substantially orthogonal angle or orthogonal angle.

A center point of the disengagement member may be located along the centerline of the electrical cord.

An electrical connector for facilitating disconnection from an electrical device by an operator includes an electrical cord having a centerline and an electrical plug device attached to an end of the electrical cord and having a planar surface. The electrical plug device includes an electrical connector perpendicular to the planar surface of the electrical plug device and a disengagement member. The electrical connector is located along the centerline of the electrical cord. The disengagement member is offset from the centerline of the electrical cord. The electrical cord is electrically connected to the electrical connector through the electrical plug device.

The electrical plug device may include plug reinforcement member for the electrical connector, the plug reinforcement member being offset from the centerline of the electrical cord.

The disengagement member may include a tactilely discernible indentation to inform a user where to apply a pushing action so as to disengage the electrical connector from the electrical device.

The disengagement member may include a tactilely discernible protrusion to inform a user that a pushing action is to be applied to an opposite side so as to disengage the electrical connector from the electrical device.

The disengagement member may include a visible human readable demarcation to inform a user where to apply a pushing action so as to disengage the electrical connector from the electrical device.

An electrical connector for facilitating disconnection from an electrical device by an operator includes an electrical cord having a centerline and an electrical plug device attached to an end of the electrical cord and having a planar surface. The electrical plug device includes an electrical connector perpendicular to the planar surface of the electrical plug device, a first disengagement member, and a second disengagement member. The electrical connector is located along the centerline of the electrical cord. The first and second disengagement members are offset from the centerline of the electrical cord. The electrical cord is electrically connected to the electrical connector through the electrical plug device.

The electrical plug device may include a plug reinforcement member for the electrical connector, the plug reinforcement member being offset from the centerline of the electrical cord.

The disengagement member may include a tactilely discernible indentation to inform a user where to apply a pushing action so as to disengage the electrical connector from the electrical device.

The disengagement member may include a tactilely discernible protrusion to inform a user that a pushing action is to be applied to an opposite side so as to disengage the electrical connector from the electrical device.

The disengagement member may include a visible human readable demarcation to inform a user where to apply a pushing action so as to disengage the electrical connector from the electrical device.

A line, passing through a center point of the disengagement member and a center point of the electrical connector may intersect the centerline of the electrical cord to form a substantially orthogonal angle.

The first disengagement member and the second disengagement member may be an integrally formed disengagement member; the first disengagement member being offset to a first side from the centerline of the electrical cord and the second disengagement member being offset to a second side from the centerline of the electrical cord such that the first disengagement member and the second disengagement member are co-planar.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrical connection device for providing electrical power to an electrical device, consisting essentially of:

an electrical cord having a centerline; and an electrical plug device attached to an end of said electrical cord and having a first planar surface and a second planar surface;

said electrical plug device including, an electrical connector, located on said first planar surface of said electrical plug device and being perpendicular to said first planar surface of said electrical plug device, for physically and electrically connecting said electrical plug device to the electrical device, and a disengagement member located on said centerline of said single electrical cord;

said disengagement member having a first surface, said first surface of said disengagement member being a portion of said first planar surface of said electrical plug device;

said disengagement member having a second surface, said second surface of said disengagement member being a portion of said second planar surface of said electrical plug device;

said single electrical connector being offset from said centerline of said electrical cord;

said disengagement member having a center point, said center point being located on said centerline of said electrical cord;

said electrical cord being electrically connected to said electrical connector through said electrical plug device;

said disengagement member including an indentation in said first surface of said disengagement member identifying a location on said first surface of said disengagement member where to apply a force, the applied force being both orthogonal to said first planar surface of said disengagement member and parallel to said electrical connector.

2. The electrical connection device, as claimed in claim 1, wherein said electrical plug device includes plug reinforcement member for said electrical connector, said plug reinforcement member being offset from said centerline of said electrical cord.

3. The electrical connection device, as claimed in claim 1, wherein said disengagement member includes a protrusion in said second surface of said disengagement member.

4. The electrical connection device, as claimed in claim 3, wherein said indentation includes a bottom surface below said first surface of said disengagement member;

said disengagement member including a demarcation within said bottom surface of said indentation of said disengagement member identifying a location on said first surface of said disengagement member where to apply a force, the applied force being both orthogonal to said first surface of said disengagement member and parallel to said electrical connector.

5. The electrical connection device, as claimed in claim 1, wherein said indentation includes a bottom surface below said first surface of said disengagement member;

said disengagement member including a demarcation within said bottom surface of said indentation of said disengagement member identifying a location on said first surface of said disengagement member where to apply a force, the applied force being both orthogonal to said first surface of said disengagement member and parallel to said electrical connector.

6. The electrical connection device, as claimed in claim 1, wherein a line, passing through said center point of said disengagement member and a center point of said electrical connector intersects said centerline of said electrical cord to form a substantially orthogonal angle.

7. The electrical connection device, as claimed in claim 1, wherein a line, passing through said center point of said disengagement member and a center point of said electrical connector intersects said centerline of said electrical cord to form an orthogonal angle.

8. An electrical connection device for providing electrical power to an electrical device, consisting essentially of:

an electrical cord having a centerline; and an electrical plug device attached to an end of said electrical cord and having a first planar surface and a second planar surface;

said electrical plug device including, an electrical connector, located on said first planar surface of said electrical plug device and being perpendicular to said first planar surface of said electrical plug device, for physically and electrically connecting said electrical plug device to the electrical device, and a disengagement member;

said disengagement member having a first surface, said first surface of said disengagement member being a portion of said first planar surface of said electrical plug device;

said disengagement member having a second surface, said second surface of said disengagement member being a portion of said second planar surface of said electrical plug device;

said electrical connector being located on said centerline of said electrical cord;

said disengagement member being offset from said centerline of said electrical cord;

said electrical cord being electrically connected to said electrical connector through said electrical plug device;

said disengagement member includes an indentation in said first surface of said disengagement member identifying a location on said first surface of said disengagement member where to apply a force, the applied force being both orthogonal to said first surface of said disengagement member and parallel to said electrical connector;

said indentation of said disengagement member not intersecting said centerline of said electrical cord.

9. The electrical connection device, as claimed in claim 8, wherein said disengagement member includes a protrusion in said second surface of said disengagement member.

10. The electrical connection device, as claimed in claim 9, wherein said indentation includes a bottom surface below said first surface of said disengagement member;

said disengagement member including a demarcation within said bottom surface of said indentation of said disengagement member identifying a location on said first surface of said disengagement member where to apply a force, the applied force being both orthogonal to said first surface of said disengagement member and parallel to said electrical connector.

11. The electrical connection device, as claimed in claim 8, wherein said indentation includes a bottom surface below said first surface of said disengagement member;

said disengagement member including a demarcation within said bottom surface of said indentation of said disengagement member identifying a location on said first surface of said disengagement member where to apply a force, the applied force being both orthogonal to said first surface of said disengagement member and parallel to said electrical connector.

12. An electrical connection device for providing electrical power to an electrical device, consisting essentially of:

an electrical cord having a centerline; and an electrical plug device attached to an end of said electrical cord and having a first planar surface and a second planar surface;

said electrical plug device including, an electrical connector, located on said first planar surface of said electrical plug device and being perpendicular to said first planar surface of said electrical plug device, for physically and electrically connecting said electrical plug device to the electrical device, a first disengagement member, and a second disengagement member;

said first disengagement member having a first surface, said first surface of said first disengagement member being a portion of said first planar surface of said electrical plug device;

said first disengagement member having a second surface, said second surface of said first disengagement member being a portion of said second planar surface of said electrical plug device;

said second disengagement member having a third surface, said third surface of said second disengagement member being a portion of said first planar surface of said electrical plug device;

said second disengagement member having a fourth surface, said fourth surface of said second disengagement member being a portion of said second planar surface of said electrical plug device;

said electrical connector being located on said centerline of said electrical cord;

said first disengagement members being offset from said centerline of said electrical cord;

said second disengagement member being offset from said centerline of said electrical cord;

said electrical cord being electrically connected to said electrical connector through said electrical plug device;

said first disengagement member including first indentation in said first surface of said first disengagement member to identify a location on said first surface of said first disengagement member where to apply a force, the applied force being both orthogonal to said first surface of said first disengagement member and parallel to said electrical connector;

said second disengagement member including second indentation in said third surface of said second disengagement member to identify a location on said third surface of said second disengagement member where to apply a force, the applied force being both orthogonal to said third surface of said second disengagement member and parallel to said electrical connector;

said first indentation of said first disengagement member not intersecting said centerline of said electrical cord;

said second indentation of said second disengagement member not intersecting said centerline of said electrical cord.

13. The electrical connection device, as claimed in claim 12, wherein said first disengagement member includes a protrusion in said second surface of said first disengagement member; and said second disengagement member includes a protrusion in said fourth surface of said second disengagement member.

14. The electrical connection device, as claimed in claim 13, wherein said disengagement member includes a demarcation in said first surface of said disengagement member identifying a location on said first surface of said first disengagement member where to apply a force, the applied force being both orthogonal to said first surface of said disengagement member and parallel to said electrical connector; and said second disengagement member includes a demarcation in said third surface of said second disengagement member identifying a location on said third surface of said second disengagement member where to apply a force, the applied force being both orthogonal to said third surface of said second disengagement member and parallel to said electrical connector.

15. The electrical connection device, as claimed in claim 12, wherein said disengagement member includes a demarcation in said first surface of said disengagement member identifying a location on said first surface of said first disengagement member where to apply a force, the applied force being both orthogonal to said first surface of said disengagement member and parallel to said electrical connector; and said second disengagement member includes a demarcation in said third surface of said second disengagement member identifying a location on said third surface of said second disengagement member where to apply a force, the applied force being both orthogonal to said third surface of said second disengagement member and parallel to said electrical connector.

* * * * *